United States Patent [19]

Schiessl et al.

[11] 4,173,931

[45] Nov. 13, 1979

[54] INCENDIARY WARHEAD

[75] Inventors: Alois Schiessl, Marzoll, Fed. Rep. of Germany; Georg Praehauser, Oberalm, Austria; Wolfgang Badura, Turek-Marzoll; Wolfgang Trede, Weil am Rhein, both of Fed. Rep. of Germany

[73] Assignee: Firma BUCK Chemisch-Technische Werke GmbH. & Co., Bad Ueberkingen, Fed. Rep. of Germany

[21] Appl. No.: 879,599

[22] Filed: Feb. 21, 1978

[51] Int. Cl.[2] ..... F42B 13/44

[52] U.S. Cl. ..... 102/90; 102/7.2; 102/69

[58] Field of Search ..... 102/6, 7.2, 34.4, 35.6, 102/37.6, 37.8, 65, 66, 69, 90

[56] References Cited

U.S. PATENT DOCUMENTS

| | | | |
|---|---|---|---|
| 3,736,878 | 6/1973 | Guntermann | 102/90 |
| 3,888,179 | 6/1975 | Nord | 102/66 |
| 3,961,579 | 6/1976 | Faber | 102/90 |
| 4,015,355 | 4/1977 | Schiessl | 102/90 |

FOREIGN PATENT DOCUMENTS

| | | | |
|---|---|---|---|
| 1913790 | 10/1970 | Fed. Rep. of Germany | 102/37.6 |
| 2071272 | 8/1971 | France | 102/7.2 |

*Primary Examiner*—Verlin R. Pendegrass

*Attorney, Agent, or Firm*—Burns, Doane, Swecker & Mathis

[57] ABSTRACT

An incendiary warhead comprises a destructible body carrying a plurality of stacked incendiaries. Each incendiary comprises a housing containing a compressed three-part icendiary filling. The filling comprises a flame substance for forming an intense flame, a thermit unit for forming a red-hot slag, and a combustion transfer substance which projects into both the flame substance and the thermit substance to be ignited by the former and ignite the latter. A tail unit is mounted at a top end of the housing to control the rate of descent of the incendiary. The tail comprises a hook, a pair of chains connected to the hook, and a vane connected to the free end of each chain. An anchor point extends from a bottom end of the housing and is in the shape of an arrowhead having barbed side edges.

13 Claims, 5 Drawing Figures

INCENDIARY WARHEAD

BACKGROUND AND OBJECTS OF INVENTION

The invention concerns a warhead comprising a rocket-propelled body and incendiary agents which are stacked within the body and which after their ignition are ejected from the body by a bursting charge and are spread over the target area.

Such incendiary agents must possess a great number of characteristics related to their incendiary effect, some of the desired characteristics even being in conflict with each other. Thus, conventional incendiary agents, or their compositions are able to only partially meet the requirements. There exist incendiary fillings with an extensive combustion period and a satisfactory flame effect but without any destructive effect on the surrounding base area. The best known example of this type of incendiaries is Napalm where the combustion is limited to the vapors of the solvent so that the base area to which the burning mass is sticking will generally reach only the comparatively low temperature of the solvent's boiling point.

There are also known incendiary fillings with a thermit base. These thermit compositions have a high reaction temperature and form a red-hot, base-destroying slag but the incendiary effect of these compositions is poor in an upward direction and the period of combustion is very brief.

Furthermore, it is necessary to take into consideration the problem that the incendiary agents must be ignited inside the warhead in order to avoid the use of complicated igniters at a later stage, while the actual incendiary effect should develop later on, that is upon, or after striking the base areas.

It is, therefore, an object of the invention to provide a warhead of the above defined type, wherein the incendiary agents will adhere to a great variety of base areas, and will have a destructive, downwardly directed effect on these base areas while simultaneously emitting a long-lasting, powerful flame effect in an upward direction.

BRIEF SUMMARY OF INVENTION

The invention solves this problem in that the incendiary agents comprise a housing in the form of a cup, closed-off by a cover, and a three-section incendiary filling, pressed into the cup. Protruding from the bottom of the cup is an anchoring point, and from the cover of the cup a tail unit. The incendiary filling comprises one flame unit which reacts over a long period of combustion while forming a powerful flame, one thermit unit which reacts for a short period of combustion while forming a red-hot slag, and one transfer unit which is placed between, and completely enveloped by, the flame unit and the thermit unit and which will ignite readily and burn while generating a great amount of heat.

The incendiary filling preferably comprises a flame unit with a red phosphor base and organic binding agents, a thermit unit with a base of aluminum and $Fe_3O_4$, and a transfer unit with a base of aluminum, magnesium, $Fe_2O_3$ and $Fe_3O_4$.

The incendiary agents will spread out over the target area and then drop down by gravity force, being directionally stabilized by the tail unit so that they will strike the base area with their anchoring point and adhere to this area, whether it consists of earth, wood (trees), sheet metal (automobile, aircraft) or textiles (truck tarpaulins). The flame unit will be the first to burn, over a long period of combustion and generating a powerful flame. During the course of its combustion the flame unit will ignite the transfer unit which in turn then ignites the thermit unit which will form a red-hot slag and destroy the base area.

If the incendiary agent drops close to an inflammable object, this object will be ignited by the powerful flames of the flame unit, burning for a long period of time. If the incendiary drops directly onto the object to be ignited, for example, the roof of an automobile, the object will not be greatly damaged by the upwardly directed flames of the flame unit but the red-hot slag of the thermit unit will then destroy the surface of the object, in this case the roof of the car, will enter the object proper and then ignite its interior.

The warhead proposed by the invention has therefore a very broad field of application, and the probability that the incendiaries will actually ignite all targets, even of very diverse type, present within the target area, is substantially greater than in the case of incendiaries used heretofore since their effectiveness is influenced to a much greater degree by the type of the target object and the position of the incendiary relative to the target object.

Further features of the invention, especially concerning the tail unit, the anchoring point, the igniting device and the bursting charge are described in more detail hereinafter.

THE DRAWING

FIG. 1 is a side view in partial longitudinal section one portion of the warhead according to the invention, FIG. 2 depicts an incendiary in longitudinal section, FIG. 3 is a side view of the incendiary depicted in FIG. 2 ready for installation, FIG. 4 shows the incendiary of FIG. 3 in top view, and FIG. 5 illustrates the airborne tail unit of the incendiary shown in FIG. 3.

DETAILED DESCRIPTION OF A PREFERRED EMBODIMENT OF THE INVENTION

Figure 1:
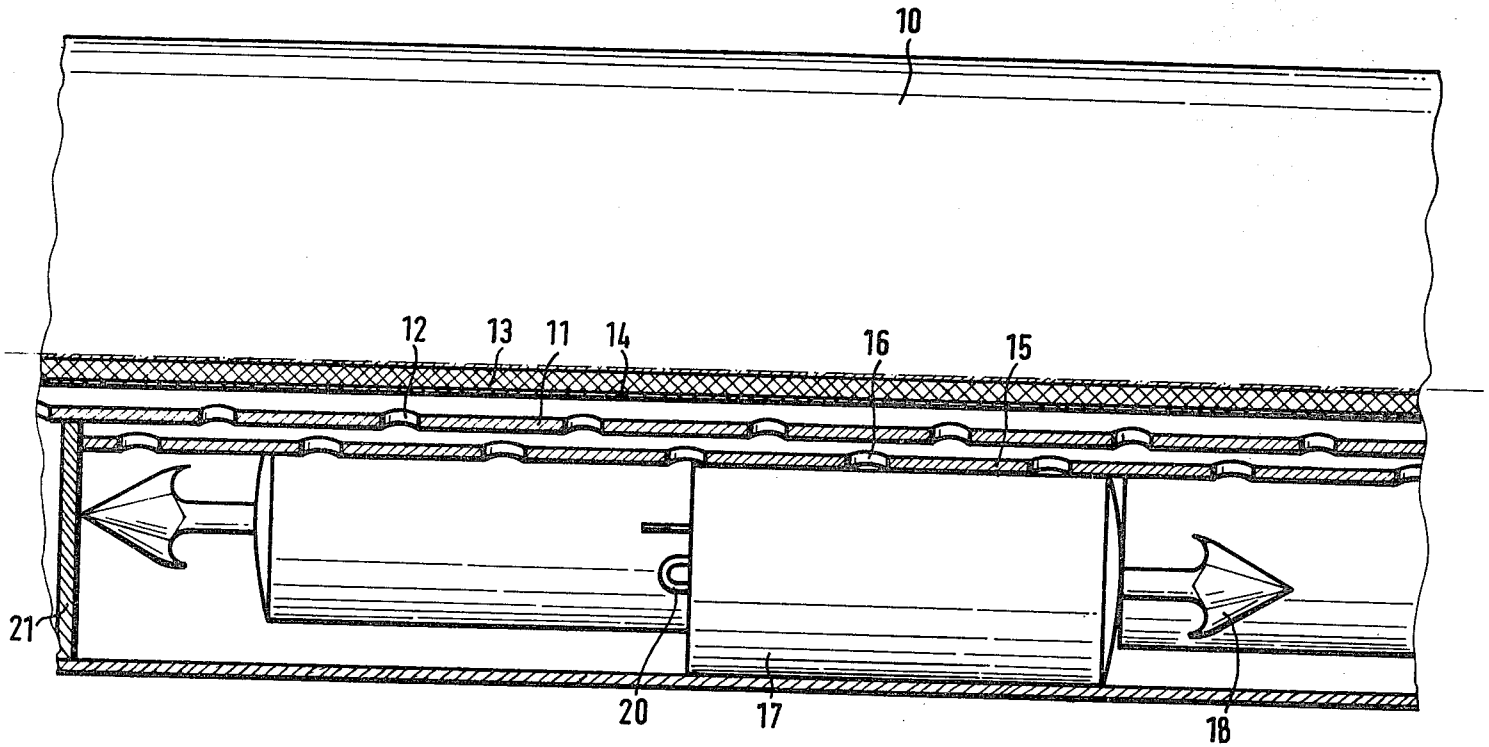

The warhead proposed by the invention has a basic construction that is similar to the warhead illustrated in FIG. 1 of German Pat. No. 1,913,790. Such a warhead comprises a projectile nose with a point-detonating fuse. The nose is connected by way of a predetermined breaking area with an incendiary-containing body in such manner that it can be blown off. The warhead is traversed centrally by an ignition tube which is provided with flash holes and which accommodates the mass to be ignited. The tube extends from the point-detonating fuse to a hollow area located within the area of the body base. Further details may be found by inspecting the German patent.

FIG. 1 depicts a partial section of a warhead according to the invention which is of such basic construction. A body 10 is traversed by an ignition tube 11 containing flash holes 12. The tube 11 contains a tube 14 which holds the mass 13 to be ignited. The tube 11 is made of sheet steel, and the tube 14 is made of aluminum. In addition to these two tubes 11, 14, known from German Pat. No. 1,913,790, there is provided a protective tube 15 having flash holes 16 which surrounds the ignition tube 11 concentrically. The protective tube 15 is made of cardboard and its flash holes 16 are offset axially relative to the flash holes 12 of the ignition tube 11.

A plurality of incendiaries 17 are arranged around the protective tube 15 in several layers, superposed and angularly displaced. The incendiaries located within one cross-sectional plane have a distance from each other that is just sufficient to accommodate the anchoring point 18 (or the tail unit hook 20) of the incendiary that is located in staggered relation above this layer. The anchoring point 18 also serves the purpose of holding the incendiary in position. The blade-shaped anchoring point, together with the sheet strip 24*a* which protrudes from the cover 24 and enters the gap between the two incendiaries above it, will prevent the incendiary unit from turning about its own axis. In this manner the flash holes are kept free of incendiary units located above them. Numeral 21 (FIG. 1) denotes a cover plate which is located within the region of the predetermined breaking area of the warhead to protect the stack of incendiaries against the warhead nose which can be blown off.

Figure 2:
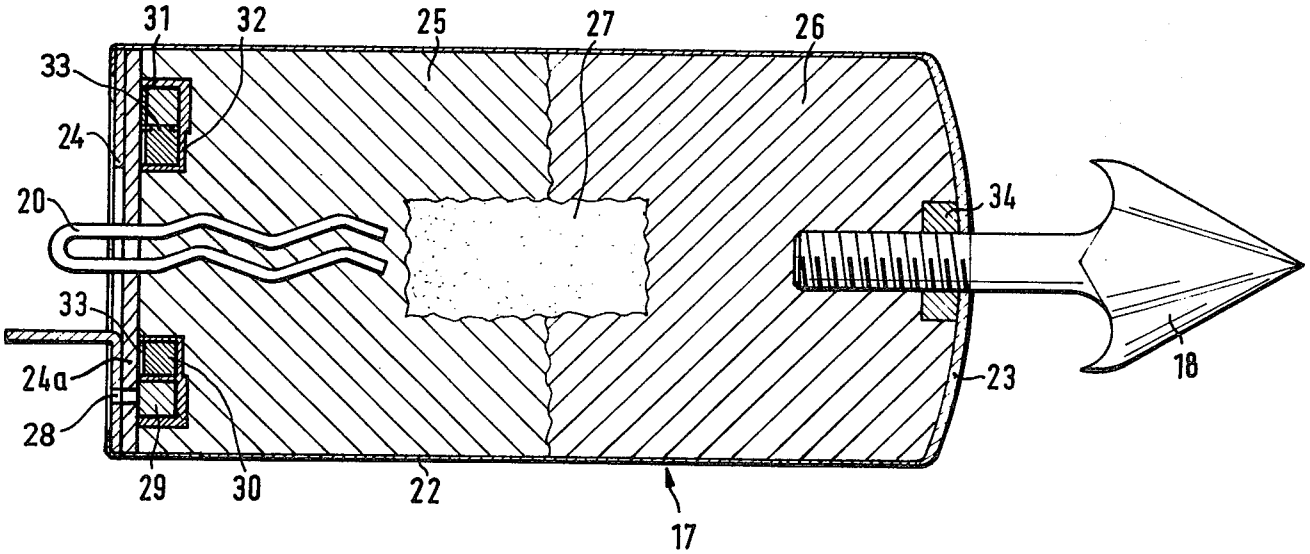

FIG. 2 depicts one individual incendiary unit 17 in longitudinal section. The incendiary unit 17 mainly comprises a cup-shaped housing 22 including one-piece bottom 23 and an inserted cover 24, and a three-section incendiary filling. This filling comprises a flame unit 25, a thermit unit 26 and a transfer unit 27. The drawing shows the location of these units inside the housing, i.e., the frame unit 25 is adjacent the cover 24, the thermit unit 26 is adjacent the bottom 23, and the transfer unit 27 is in the center area. One end of the transfer unit 27 juts into the flame unit and the other end juts into the thermit unit. The transfer unit 27 is covered on all sides by these flame and thermal units.

The flame unit 25 has a base of red phosphor with organic binding agents. The thermit unit 26 has a base of aluminum and $Fe_3O_4$. The transfer unit 27 has a base of aluminum, magnesium, $Fe_2O_3$ and $Fe_3O_4$. It is essential that the transfer unit 27 can ignite more readily than the two other units 25 and 26 and can burn with a flame sufficiently hot to ignite the thermit unit 26 which is not easily flammable. This specific arrangement has the result that the combustion of the flame unit 25 will be completed to a large extent prior to the beginning of the thermit reaction. Otherwise, the violent thermit reaction would lead to an ineffective, transitory spray of the flame unit. It is the powerful flame effect, lasting over an extensive period of time, which will produce area configurations.

This three-section incendiary filling is assembled by placing the thermit unit 26, the transfer unit 27 and the flame unit 25 successively into the cup-shaped housing 22, 23, and by subsequently subjecting all units to a high compressive pressure. The transfer unit 27 will thus be located in the center of the pressed incendiary filling, being covered on all sides by the two other units. The transfer unit 27 is thereby imbedded in the thermit unit 26 as well as in the flame unit 25 and is seamlessly connected with both units by mutual compression, providing a definite and secure transfer of ignition. The high compression of the incendiary composition as well as the admixture of binders to the flame unit 25 will insure a high stability of the incendiary entity at the time of impact at the target, and will further insure that the entity will be safe from ignition by the jet of flame from the bursting charge of the warhead, even if for one reason or another this jet of flame from the bursting charge should come in contact with the flame or the thermit unit.

The igniting system is formed by a circular capsule which contains two continuous annular ducts located side-by-side. The radially outermost annular duct 31 contains a delay action composition, and the radially innermost annular duct 32 contains a hot-tube igniter 30. Both ducts are masked by means of circular discs in such manner that the rims of the duct project slightly and press into a superposed rubber disc 24 *a* which is forced down by the cover 24. In this simple and inexpensive manner there is attained an absolutely gas-tight ignition system and thus a great stability during storage.

The outer annular duct 31 is in communication with an igniter opening 28 and is also provided with a break so that the blaze of the delay-action composition 29 can extend in one direction only. A flash hole 33 communicates the outer annular duct 31 with the inner annular duct 32, and thus communicates the delay-action composition 29 with the hot-tube igniter 30. By varying the position of the flash hole 33 it becomes possible to extend, or shorter, the burning time of the composition 29, and thereby the time of delay. It is therefore possible to predetermine in a simple and economic manner the time delay as desired without modifying the igniting system. The walls of the outer annular duct 31 should be thicker than the walls of the inner annular duct 32, firstly in order to prevent a premature ignition of the flame unit by the delay-action composition, and secondly in order to insure a proper ignition of the flame unit by the hot-tube igniter. A priming compound, not illustrated, can be placed at the top of the delay-action composition 29, if desired. Therefore, when an igniting jet of flame strikes the opening 28, the firing sequence is as follows: (if present), delay-action composition 29, hot-tube igniter 30, flame unit 25, transfer unit 27, and thermit unit 26.

The anchoring point 18 is pressed, as shown by FIG. 2, into the thermit unit 26 and is supported there by a tightly threaded seating disc or nut 34 in such secure manner that it cannot be forced into the compressed incendiary assembly when it strikes the target. This arrangement makes it certain that the point 18 will penetrate any target object and become anchored therein due to the velocity reached by the incendiary 17 at impact. The point is shaped in such manner that it will penetrate, and become anchored within, sheet steel as well as many other materials such as wood, truck tarpaulins, automobile tires and the like. Two factors are important in this respect, ciz., the shape of the point (most advantageously an arrow type with two barbs as illustrated in the drawing) as well as the distance of the point from the housing bottom 23. It will further be expedient to use a curved, slightly convex, housing bottom 23. This specific design will not only facilitate the anchoring but will also increase the stability of the housing. The anchoring by means of a point instead of adhesion offers the substantial advantage that the target will suffer mechanical damage so that the reaction by the thermit unit may come to bear directly within the target by way of the opening produced by the anchoring point so that the unit will act at maximum efficiency.

Figure 4:
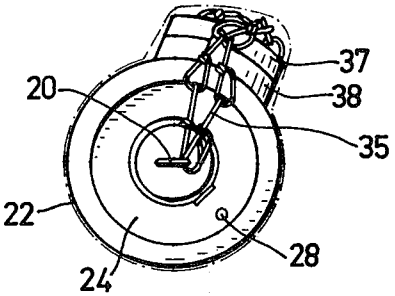
Figure 3:
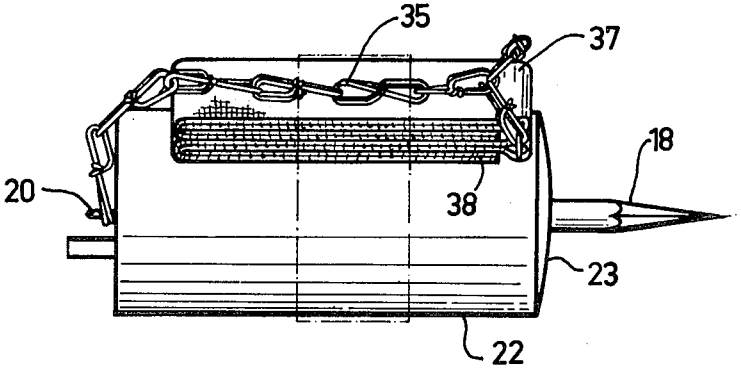
Figure 5:
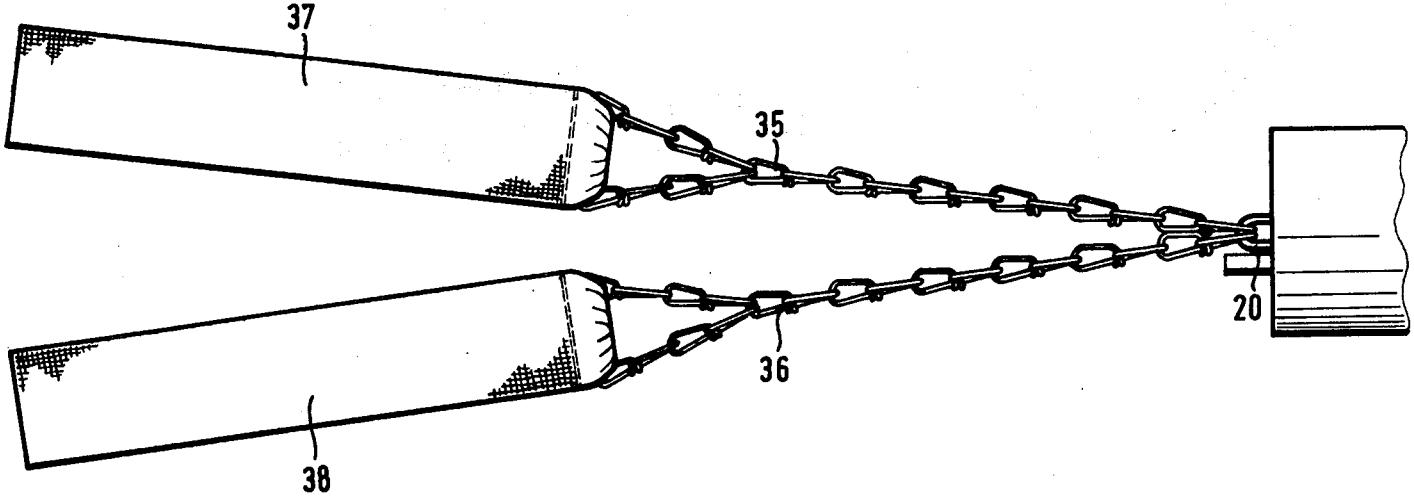

Obviously, provisions must be made to insure that the incendiary 17 will arrive at the target with the anchoring point 18 directed downwardly. This is accomplished by the use of a tail unit which is attached to the ignition side of the incendiary 17. It will be necessary however, to take into consideration the fact that the tail unit, at the time of its ejection from the warhead, is subjected to extraordinarily high mechanical and thermal stresses by the bursting charge. Since the contents of the body are discharged by suction, as will be explained later on, the incendiaries 17 are removed from the body 10 primarily by a pulling action at the tail unit. Tests have shown that a rigid tail unit will be bent out of shape during this operation, while in the case of a flexible tail unit there exists the danger that it will be torn off. The tail unit must furthermore be nonflammable or at least be highly resistant to combustion. These requirements are met by a tail unit which comprises the hook 20, two chains 35 and 36 and two vanes 37 and 38. The hook 20 includes a crooked end pressed into the flame unit 25 as shown in FIG. 2. The two chains 35 and 36 are suspended at one end from the hook 20, with their other ends are connected to the vanes 37 and 38. These vanes 37 and 38 comprise a textile, preferably tarpaulin, impregnated with flame-proof substances. The vanes are fastened to the chains in such manner that they can be torn off only by a very powerful deformation. The same applies to the fastening of the chains at the hook. This tail unit is not only very rugged but offers the additional advantage that it will absorb the sudden shock occurring at the ejection of the incendiaries 17. Furthermore, this tail unit occupies very little space when the incendiaries are stacked within the body, as illustrated by FIGS. 3 and 4. This tail unit will not only make certain that the incendiaries hit the target with the point 18 but has the additional task of braking the fall of the incendiaries 17 and limiting them to a certain maximum speed. The incendiaries would, in the absence of any braking action, penetrate soil too deeply and would then be able to generate an area configuration. Also, in case of an impact on sheet metal to the rebound could become so strong that no anchoring would otherwise occur. In the extreme case, the mechanical strength of the package could be exceeded and the incendiaries would break up or burst apart without causing any damage at impact. On the other hand, if the incendiaries 17 are braked excessively, the anchoring point 18 would lack sufficient strength to penetrate sheet steel at impact and the incendiaries would not adhere to the target. The impact velocity can be set at optimum values by a suitable dimensioning of the tail unit, and especially of the two vanes, and by taking into consideration the weight of the incendiaries.

The warhead functions in the following manner. When the target area has been reached, a fuse located in the nose of the warhead ignites the bursting charge 13. The ignited bursting charge 13 tears open the aluminum tube 14 and sends jets of flames through the holes 12 of the ignition tube 11 and through the offset holes 16 of the protective tube 15, the latter being now destroyed into the area of the body 10 containing the incendiaries 17. The protective tube 15 serves to deflect and attenuate these jets of flames. In this manner any damage to the incendiaries 17 will be avoided but without significant reduction in the flame temperature required for the ignition of the incendiaries 17. The projectile nose is blown off in a known manner along a predetermined breaking area, together with the ignition tube 11. The gases of combustion from the burning bursting charge will then push the incendiaries 17 out of the body. Due to the above-described manner of stacking of the incendiaries 17 inside the body 10, a great number of hollow spaces are created throughout the entire length of the body. This causes a considerable suction effect so that the packages 17 are not pushed, but rather are torn or pulled from the body. It will therefore not even be necessary to employ diaphragms (standard equipment for known ejection devices) located between a hollow area in the rear part of the body and the incendiaries to be ejected. The flames of the bursting charge 13 will ignite the incendiaries before they leave the body 10. The ignition is accomplished by way of the openings 28, located at the cover 28 of each incendiary, so that the delay-action composition 29 is ignited, possibly by way of a priming compound.

When the incendiaries 17 drop, the tail units thereof will unfold, stabilizing the flight and limiting the velocity of fall. Upon impact, the anchoring point will penetrate the target object and anchor the incendiary in such manner that it will sit upright at the surface of the target object. In the meantime, the delay-action composition 29 ignites the hot-tube igniter 30 which in turn ignites the flame unit 25.

Target objects, or portions of the object, which are located next to, or above the incendiary are now brought to combustion and will thus create an area conflagration.

Before the flame unit 25 is burned out completely, it ignites the transfer unit 27 which in turn ignites the thermit unit 26. The thermit unit 26 will now burst into combustion, developing a very hot flame and forming a red-hot molten mass which will destroy the base area, possibly flowing into the interior of the target object through the opening cut by the anchoring point 18. The over-all effect will be the destruction of the target object, whether the incendiary falls near or upon the target object.

In the following paragraph some numerical values are given for the practical design and application of the invention which are to be considered examples only.

The warhead can have a diameter of 110 mm and a length of approximately 700 mm. Such warhead will accommodate approximately 45 incendiary units with a weight of 200 g each. The ejection of the incendiaries 17 from the body 10 takes place at a height of approximately 700 m above the target area. The tail unit of the incendiaries is dimensioned so that an impact velocity of 35 to 45 mm/sec is reached, and the time of fall ranging from 15 to 20 seconds. The burning time of the delay-action composition should correspond approximately to this time of fall. The anchoring point and the distance between the barbs of the anchor point and the housing bottom should be dimensioned most advantageously in such manner that at the given impact velocity and the given weight of the incendiary a sheet steel of 1.5 mm thickness will be penetrated while the incendiary will not rebound but remain anchored. The measurements and the shape of the anchoring point as illustrated by FIG. 1 (scale 1:1) will result in optimum effects.

The invention is obviously not limited to the species described, and definitely not to the specific data given. For example, the size of the incendiary units will depend on the size of the warhead, and it is possible to use incendiary units of much greater weight for very large warheads or bombs, or use a much greater number of incendiary units per warhead. Other changes or modifications may be possible within the scope of the invention.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a warhead of the type comprising a body and incendiary units which are stacked within said body and which are ignited and ejected from the body by a bursting charge, to be spread over a target area, the improvement wherein said incendiary units each comprise:

a cup-shaped housing;

a cover closing a top end of said housing;

a three-part incendiary filling compressed within said housing, said filling comprising a flame substance which forms a flame during an extended period of combustion, a thermit substance which forms a red-hot slag during a shorter period of combustion, and a transfer substance disposed between and completely enveloped by said flame substance and said thermit substance, said transfer substance being readily ignitable by said flame substance and adapted to burn with considerable heat and ignite said thermit substance;

an anchoring point projecting from a bottom end of said housing; and a tail unit connected at said top end of said housing for regulating the discent of the housing.

2. Warhead as defined in claim 1, wherein said flame substance comprises a red phosphor base and organic binding agents, said thermit unit comprises a base of aluminum and $Fe_3O_4$, and said transfer unit comprises a base of aluminum, magnesium, $Fe_2O_3$ and $Fe_3O_4$.

3. Warhead as defined in claim 1, wherein said anchoring point is pressed into said thermit unit and has the shape of an arrowhead with barbs.

4. Warhead as defined in claim 3, wherein the bottom of the incendiary housing is convexly curved and the distance between said bottom and the arrowhead of said anchoring point is selected so that a given weight of the incendiary and a given impact velocity, the anchoring point can penetrate a sheet steel of 1.5 mm thickness to anchor the incendiary at the sheet surface.

5. Warhead as defined in claim 1, wherein said tail unit comprises one hook pressed into said flame substance, two chains fastened to the hook, and two vanes fastened to the free ends of the chains.

6. Warhead as defined in claim 5, wherein said vanes are made of textile tarpaulin impregnated with a flameproof substance.

7. Warhead as defined in claim 1, wherein each incendiary includes an ignition system comprising a delay-action composition and one hot-tube igniter, said delay action-composition and hot-tube igniter arranged at the top end of the incendiary.

8. Warhead as defined in claim 7, wherein said cover has an igniting opening, and at its internal surface are disposed inner and outer concentric annular ducts, the outer annular duct containing the delay-action composition, the inner annular duct containing the hot-tube igniter, and the two annular ducts communicating by means of a flash hole.

9. Warhead as defined in claim 8, wherein the delay time of the delay-action composition is controlled by the radial position of the flash hole communicating the delay-action composition with the hot-tube igniter.

10. Warhead as defined in claim 7, further including a priming compound situated in front of the delay-action composition.

11. Warhead as defined in claim 1, including an ignition tube traversing the warhead body, a protective cardboard tube surrounding said ignition tube, said protective tube including flash holes which are offset relative to flash holes in the ignition tube.

12. Warhead as defined in claim 11, wherein said incendiaries are stacked and staggered in the warhead body in such manner that hollow areas are created and distributed throughout the entire length of the body, said cover including ignition openings facing such hollow areas.

13. Warhead as defined in claim 12, wherein incendiaries stacked upon each other engage each other by means of the anchoring points and tail units projecting from the ends thereof so that the incendiaries are securely held in place and are constrained against rotation.

* * * * *